US005393199A

United States Patent [19]

Alizadeh

[11] Patent Number: 5,393,199

[45] Date of Patent: Feb. 28, 1995

[54] FAN HAVING A BLADE STRUCTURE FOR REDUCING NOISE

[75] Inventor: Ahmad Alizadeh, Indianapolis, Ind.

[73] Assignee: Valeo Thermique Moteur, Le Mesnil-Saint Denis, France

[21] Appl. No.: 921,029

[22] Filed: Jul. 22, 1992

[51] Int. Cl.[6] ..... F04D 29/38

[52] U.S. Cl. ..... 416/189; 416/169 A; 416/DIG. 2

[58] Field of Search ..... 416/189, 195, 169 A, 416/288, DIG. 2

[56] References Cited

U.S. PATENT DOCUMENTS

| | | | |
|---|---|---|---|
| 1,542,853 | 6/1925 | Callahan | 416/189 |
| 1,724,604 | 8/1929 | Lambert | 416/189 |
| 2,211,671 | 8/1940 | Reed | 416/189 |
| 2,785,009 | 3/1957 | Stocking | 416/189 |
| 4,358,245 | 11/1982 | Gray | 416/189 |
| 4,505,641 | 3/1985 | Tsuchikawa et al. | 416/189 |
| 4,569,631 | 2/1986 | Gray, III | 416/189 |
| 4,569,632 | 2/1986 | Gray, III | 416/189 |
| 4,684,324 | 8/1987 | Perosino | 416/DIG. 2 |
| 4,840,541 | 6/1989 | Sakane et al. | 416/DIG. 2 |
| 4,915,588 | 4/1990 | Brackett | 416/189 |
| 4,930,984 | 6/1990 | Kesel et al. | 416/189 |
| 5,069,345 | 11/1991 | Kimball | 416/169 A |
| 5,184,938 | 2/1993 | Harmsen | 416/DIG. 2 |

FOREIGN PATENT DOCUMENTS 2178798 7/1986 United Kingdom .

*Primary Examiner*—John T. Kwon
*Attorney, Agent, or Firm*—Morgan & Finnegan

[57] ABSTRACT

A fan comprises a hub rotatable about a central axis and a plurality of blades each having a root region secured to the hub and extending radially outwardly to a tip region. Each blade is designed with particular characteristics to reduce noise without affecting the performance of the fan.

26 Claims, 11 Drawing Sheets

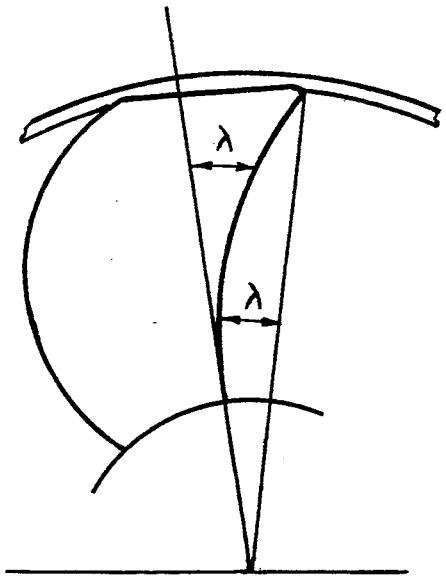
FIG. 4a
FIG. 4b
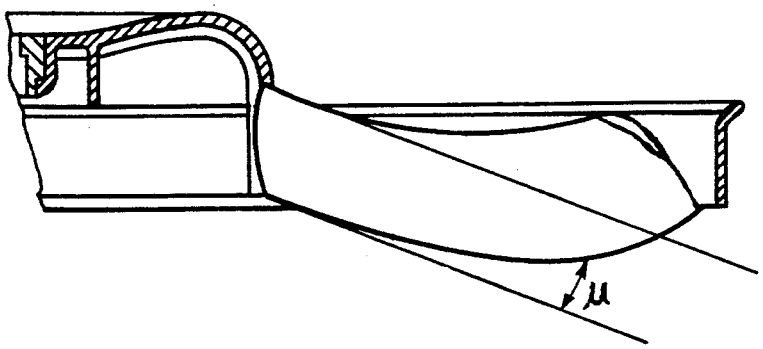
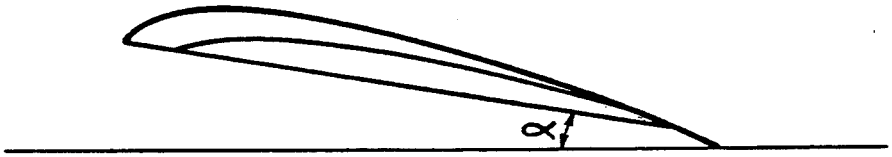
FIG. 4c

FAN HAVING A BLADE STRUCTURE FOR REDUCING NOISE

FIELD OF THE INVENTION

The present invention relates to a fan, and particularly to an axial flow fan, for example a fan designed to cool air flowing through a heat exchange system in a vehicle.

BACKGROUND TO THE INVENTION

Such axial flow fans are generally provided with a plurality of blades, each of which is secured at its root to a hub that is driven by a rotating shaft and from which the blade extends radially outwardly. The blades can be spaced around the hub in a symmetrical or non-symmetrical fashion. Axial flow fans are known having blades of various designs. Thus, the blades can be provided with a tangential sweep either in the forward or rearward direction, with variations in pitch angle to suit particular applications. Furthermore, it is known to secure the blade tips to an outer circular band which encloses the blades and is generally centered on the axis of rotation of the fan.

When used in a vehicular application, the fan can be arranged either to blow air through a heat exchange system if the heat exchange system is on the high-pressure (downstream) side of the fan or draw air through the heat exchange system if the heat exchange system is on the low-pressure (upstream) side of the fan. Such fans can be made from moulded plastics or from sheet metal or a combination of the two.

The performance of the fan is of particular concern when used to cool air in an enclosed engine compartment. More particularly, it is required to reduce the noise generated by such fans without a reduction in their performance and efficiency. Another requirement is that the fan should be strong enough to resist the stresses applied to it at high flow rates, and in adverse operating environments.

Reference is made to the following documents which describe fans designed particularly for vehicular cooling applications.

U.S. Pat. Nos. 4358245, 4569631 and 4569632 disclose a fan of the general type with which the present invention is concerned and which has blades which are skewed forwardly or rearwardly or have a combination of forward and rearward skews to improve efficiency and reduce noise. GB-A-2178798 describes a fan having blades with a relatively more forwardly curved outer portion, to reduce noise.

A first object of the present invention is to provide a fan having greater mechanical strength without loss of efficiency and flow performance characteristics as compared with the fans described in these prior art documents.

A second object of the invention is to provide a fan exhibiting lower noise.

SUMMARY OF THE INVENTION

According to a first aspect of the present invention there is provided a fan comprising a hub rotatable about an axis at the centre of the fan and a plurality of blades each having a root region secured to the hub and extending radially outwardly to a tip region, wherein each blade has leading and trailing edges which each include a portion lying substantially colinearly with a respective radius extending from the centre of the fan.

In one embodiment, the leading and trailing edges each have a portion at the root region of the blade which extends substantially colinearly with a respective radius extending from the centre of the fan for a distance along the length of each of the leading and trailing edges which lies between 5% and 10% of the total length. Thereafter, the leading and trailing edges curve continuously in a forward or rearward skew.

The provision of a linear portion at the root region which extends substantially colinearly with a radius increases the strength of the blade at the root portion. In known fans, a common failure location is the root region and one of the reasons for this is that in most fans, the blade curvature away from the radius of the fan begins immediately at the root region. By reducing the curvature at the root region, less stress is applied to the root region of the blade in operation of the fan and thus the fan has a greater mechanical strength there. The inventor has discovered that the root portion of the blade does not have any significant effect on air flow through the fan and so, contrary to conventional wisdom, it does not have to have a high angle of skew to be effective.

In another embodiment, the substantially colinear portion of the leading and trailing edges lies at a point between the root region of the blade and a point lying 50% along the length of the leading and trailing edges. The leading and trailing edges are skewed in one direction from the root region, the direction of skew being changed at the substantially colinear portion. The provision of forward and rearward skews in this way reduces noise generated by the fan due to the changes in air flow which arise as it passes over the blade. This phenomenon is known in the art, for example see U.S. Pat. No. 4,569,631.

According to a second aspect of the present invention there is provided a fan comprising a hub rotatable about an axis at the centre of the fan and a plurality of blades each having a root region secured to the hub and extending radially outwardly to a tip region, wherein each blade has a root chord width, the chord being taken across an arc defined by the radius of the hub and the contact points of the leading and trailing edges with the hub, which is not greater than the chord width at the tip region, the chord at the tip being taken across an arc defined by the radius of the fan and the contact points of the leading and trailing edges with that arc.

The provision of a chord width at the root region which is less than or equal to the chord width at the tip region enables the amount of material at the root region to be reduced, and thus reduces stress concentration at that point. For a blade of given mass it is of benefit to distribute the mass according to the workload of the blade in its different regions. As the largest part of the flow occurs over the outermost 30% or so of the blade, the mass can be concentrated here and accordingly reduced at the root portion.

Preferably, the chord length increases gradually from the root region of the blade over a first portion of the span of the blade and then decreases rapidly over a second portion of the span of the blade. The blade projected width similarly increases and then decreases. In the preferred embodiment, the first portion extends for a distance lying between 50–70% of the blade span.

According to a third aspect of the present invention, there is provided a fan comprising a hub rotatable about an axis at the centre of the fan and a plurality of blades each having a root region secured to the hub and extending radially outwardly to a tip region, wherein each blade has a surface which is curved so that the dihedral angle varies along the span of the blade moving from the root to the tip, the dihedral angle being the angle defined between a plane substantially colinear to the surface of the blade and the plane containing the axis of rotation of the fan. In the preferred embodiment, the dihedral angle decreases moving from the root to the tip over a first portion of the span of the blade, said first portion being between 65–75% of the total span and then stays constant or gradually increases for the remainder of the span of the blade.

As the dihedral angle reduces, there is a greater proportion of linear flow in the compound air flow across the blade. As the maximum load is taken on the outer part of the blade span, it serves to reduce noise generation if a large part of this flow is linear.

The combination of the first and third aspects of the present invention provides a blade having both dihedral and tangential sweeps which enhances broad band noise reduction over the frequency spectrum.

Preferably, the tip regions of the blade are secured to an outer annular band which improves the structural integrity of the fan. In this case, it is preferred if the leading edge of the blade at the outermost radius is tangential to the curvature of the band to reduce boundary layer separation at the outer part of the fan.

In the preferred form, the fan is formed as a single, integral unit. That is, the fan can be formed of a high strength plastics material which can be injection moulded to provide the hub, the blades and the band, when present, as a common moulding.

For a better understanding of the present invention and to show how the same may be carried into effect, reference will now be made by way of example to the accompanying drawings.

BRIEF DESCRIPTION OF THE DRAWINGS

FIGS. 4*a*, 4*b* and 4*c* illustrate diagrammatically the sweep, dihedral and pitch respectively of a blade;

DESCRIPTION OF THE PREFERRED EMBODIMENT

Figure 1:
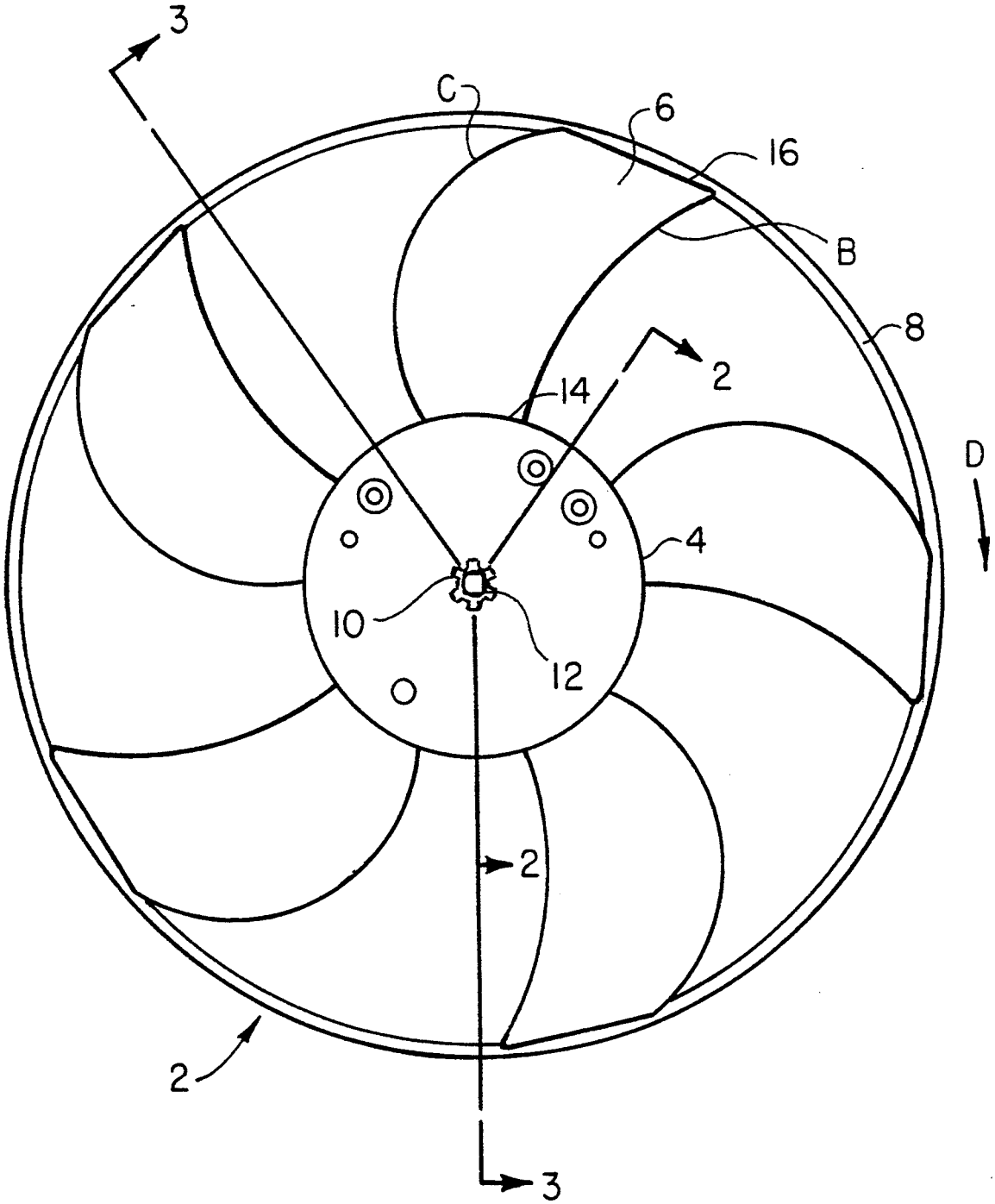
FIG. 1 is a plan view of a fan seen from the front.

FIG. 1 shows in plan view a fan 2 which includes a centrally located cylindrical hub 4 with a plurality (five as illustrated) of blades 6 extending outwardly therefrom to a cylindrical outer rim or band 8.

The hub 4 carries at its centre a hub insert 10 which defines an aperture 12 for accepting a shaft which mounts the fan for rotation around its central axis. The outer band 8 encloses the blades and is generally centered on the axis of rotation of the fan 2. Each blade 6 extends from a root region 14 secured to the hub 4 to an outer (or tip) region 16 secured to the inner surface of the band 8. The tip region 16 of the blades 6 are joined to the band over the full width of the blades and not at a single point or over a narrow connecting line. This increases the strength of the structure.

Figure 3:
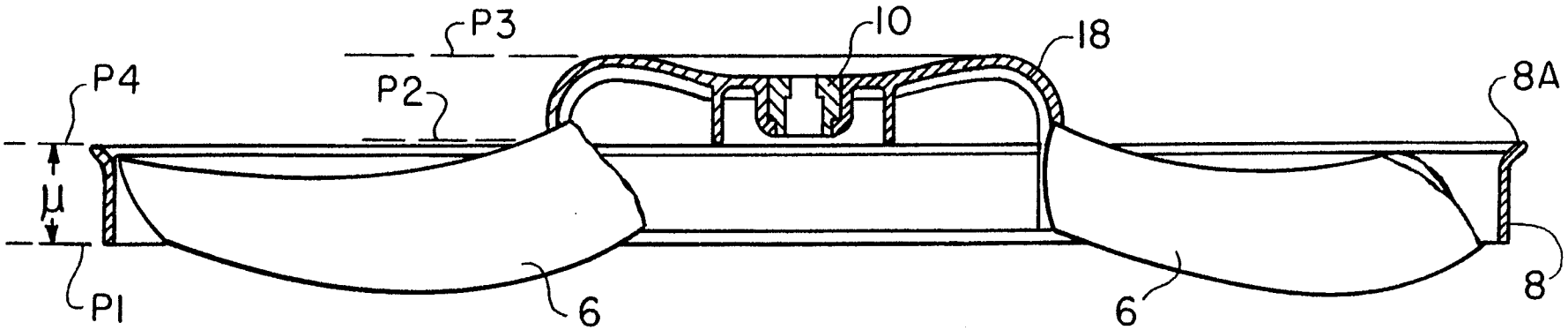
FIG. 3 is a view which is part-section taken through the fan and part perspective view to show the attachment of the blades to the hub (line III—III in FIG. 1)
Figure 3A:
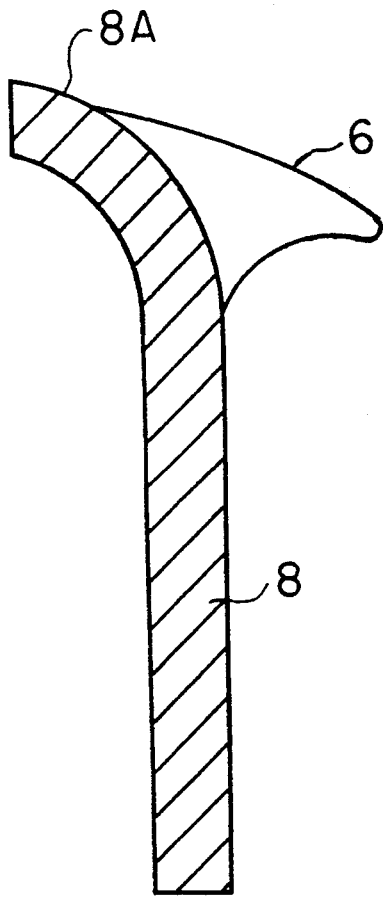
FIG. 3*a* is a view of the tip of a blade secured to the outer annular band.
Figure 10:
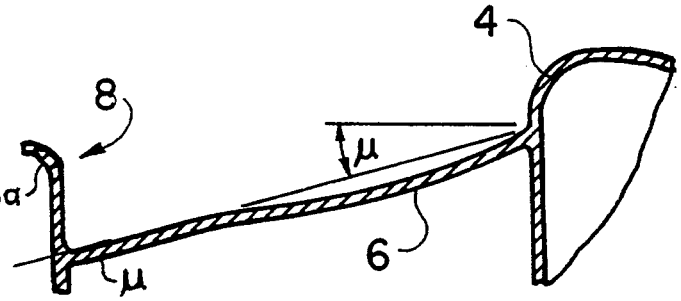
FIG. 10 is a section taken through a blade illustrating the change in dihedral along the span of the blade.

The outer band 8 of the fan adds structural strength to the fan by supporting the blades at their tip and also serves to hold air on the working surface of the blades. The band 8 is of uniform thickness but has a frontmost section 8*a* which is curved to form a funnelling effect, as shown in FIG. 10. This rounding of the band 8 reduces losses due to vortices in the gap between the fan and a shroud surrounding the fan. The band 8 furthermore provides a uniform flow passage for air flow passing through the fan and decreases unwanted variations in the dihedral angle $\mu$ (FIG. 4*b*) and the pitch angle $\alpha$ (FIG. 4*c*) of the blade. The blades 6 are shaped so that they are secured to the band 8 with the leading edge B substantially colinear to the frontmost curved section 8*a*. This can be seen in FIGS. 3 and 3*a*.

In use in a vehicular application for engine cooling, the fan can be positioned in front of or behind an engine cooling heat exchanger system comprising for example a radiator, condenser and oil cooler. The fan can be arranged so that air is either blown through the heat exchanger system if the heat exchanger is on the high pressure (downstream) side of the fan, or drawn through the heat exchanger system, if the exchanger is on the low pressure (upstream) side of the fan. The fan 2 is preferably used in conjunction with a shroud that extends between the radiator and the outer edge of the fan. The shroud serves to prevent the recirculation of air around the outer edge of the fan from the high pressure region at the downstream side of the fan to the low pressure region at the opposite side of the fan adjacent the radiator. The shroud can be any suitable structure which blocks this recirculation flow. One known structure is funnel-like as shown for example in U.S. Pat. No. 4,358,245.

Figure 5:
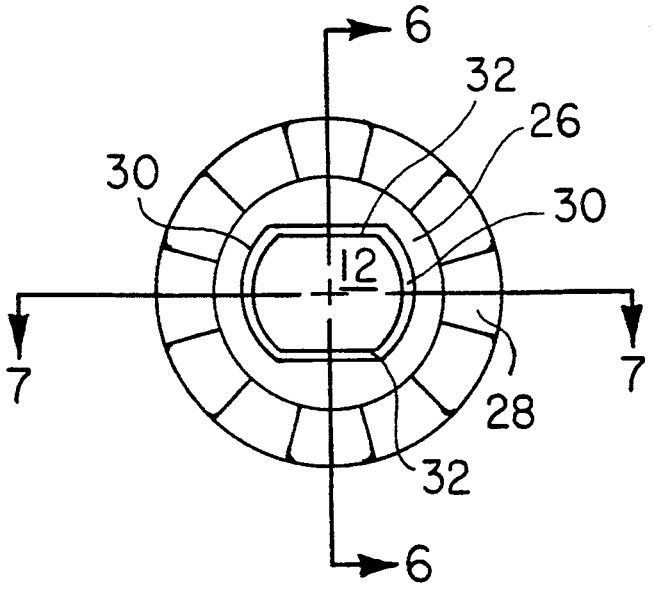
FIG. 5 is a plan view of a hub insert.
Figure 7:
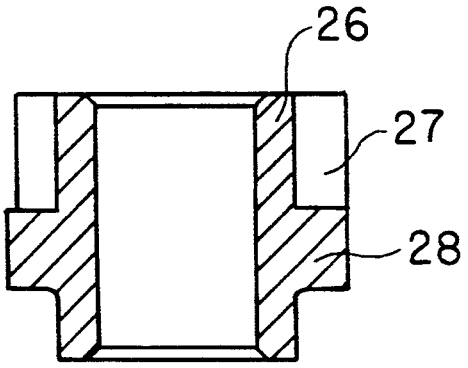
FIG. 7 is a section through FIG. 5 along the line VII—VII.
Figure 6:
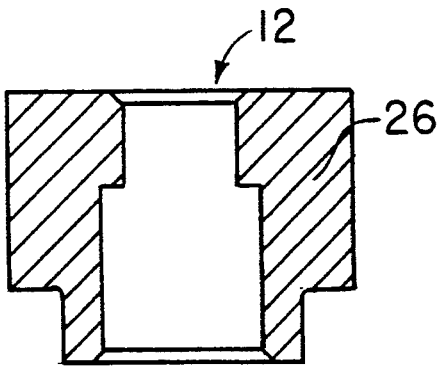
FIG. 6 is a section through FIG. 5 along the line VI—VI.

Reference will first be made to the design of the hub having regard to FIGS. 2 and 3. The hub comprises a plastic moulded body section 18 which defines an outer cylindrical ring 20 and an inner cylindrical ring 22. The inner and outer rings define between them an annular space 21. The inner cylindrical ring 22 has an internal annular ledge 24 provided for supporting a hub insert 10 as described in more detail hereinafter. The hub insert 10 is shown in more detail in FIGS. 5 to 7. The insert can be made of a plastic or metal material and comprises a solid walled cylinder 26 provided around its periphery with a plurality of protrusions 28 which form a castellated outer surface. The insert 10 defines an aperture 12 in the form of a flat sided oval, that is having end portions 30 formed by respective arcs of circles and side portions which are linear. The linear side portions 32 assist to hold a shaft inserted into the aperture 12 against rotation with respect to the hub insert 10. The castellated outer surface of the hub insert 10 enables the hub insert to be connected to the plastic moulded section 18 of the hub in a single manufacturing step. That is, a mould defining the plastic moulded body section 18 is provided in which the hub insert 10 is placed. Plastic material is injected into the mould in a known injection moulding process and enters the regions 27 (FIG. 7) in the surface of the hub insert between the protrusions 28. Thus, a secure mechanical connection is provided between the hub insert 10 and the plastic moulded section 18. The hub insert 10 provides a better fit and thus reduces the play between a shaft inserted into the aperture 12 and the insert 10. This thus helps preserve the fan balance when rotating and reduces the drift of the fan from true axial rotation.

The annular space 21 can accommodate the front plate of an electrical motor provided to drive the shaft and thus protect the motor from the intrusion of moisture and dust.

The fan hub 4 is designed to approximate a bowl shape which is more rounded than the straight cylindrical hubs of the prior art. More particularly, the hub outer surface has a central shallow depressed region 15 flanked by a substantially straight angled annular region 50. This annular region leads to a substantially flan annular region 52 which then curves into a radius 54 which passes into an outer cylindrical surface of the hub. The elimination of a sharp angle at the front part of the hub reduces losses due to vortices forming at the hub surface. This so called "vortex shedding" causes undesirable turbulence in the flow in the region of the hub.

The minimum width of the hub in the axial direction is at least equal to the blade width at the root of the blade 6. The distance between planes P1, P2 passing through the rear of the hub 4 and of the outer band 8 respectively and perpendicular to the axis of rotation may vary up to 50% of the axial extent a, of the band 8. A plane P3 passing through the front of the hub and perpendicular to the axis of rotation may coincide with a plane P4 passing through the front of the band.

Figure 2:
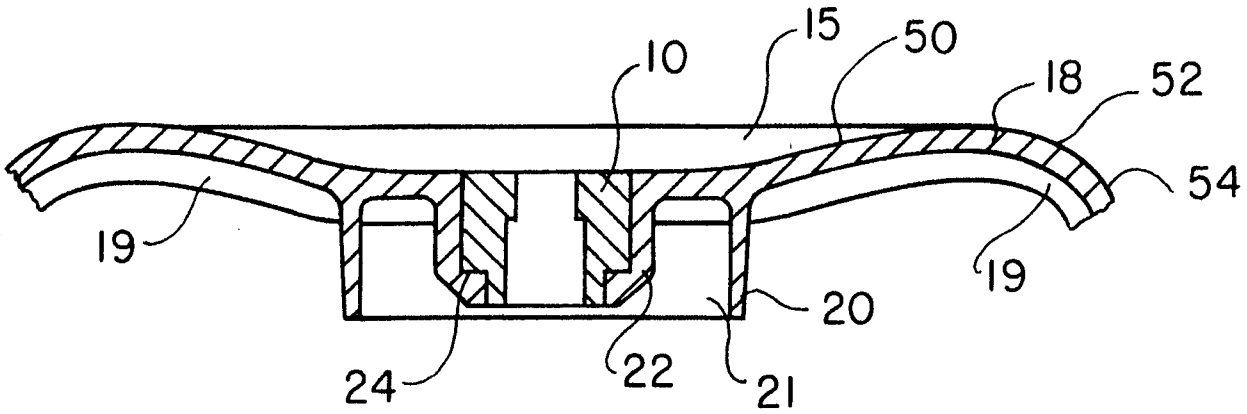
FIG. 2 is a cross-section taken through the hub of the fan along line II—II in FIG. 1.

The hub moulded section 18 is provided with a plurality of radially extending vanes, two of which can be seen in FIG. 2 designated by reference numeral 19. As can be seen from FIG. 2, and more clearly in FIG. 3, the vanes 19 are curved with the moulded plastic section 18 and serve to guide flow recirculating in the rear part of the hub in an effective manner to cool the electric motor by dissipating heat generated thereby. The vanes 19 extend inwardly towards the inner cylindrical ring 22 and thus also provide structural support for the hub body and hub insert.

Figure 14:
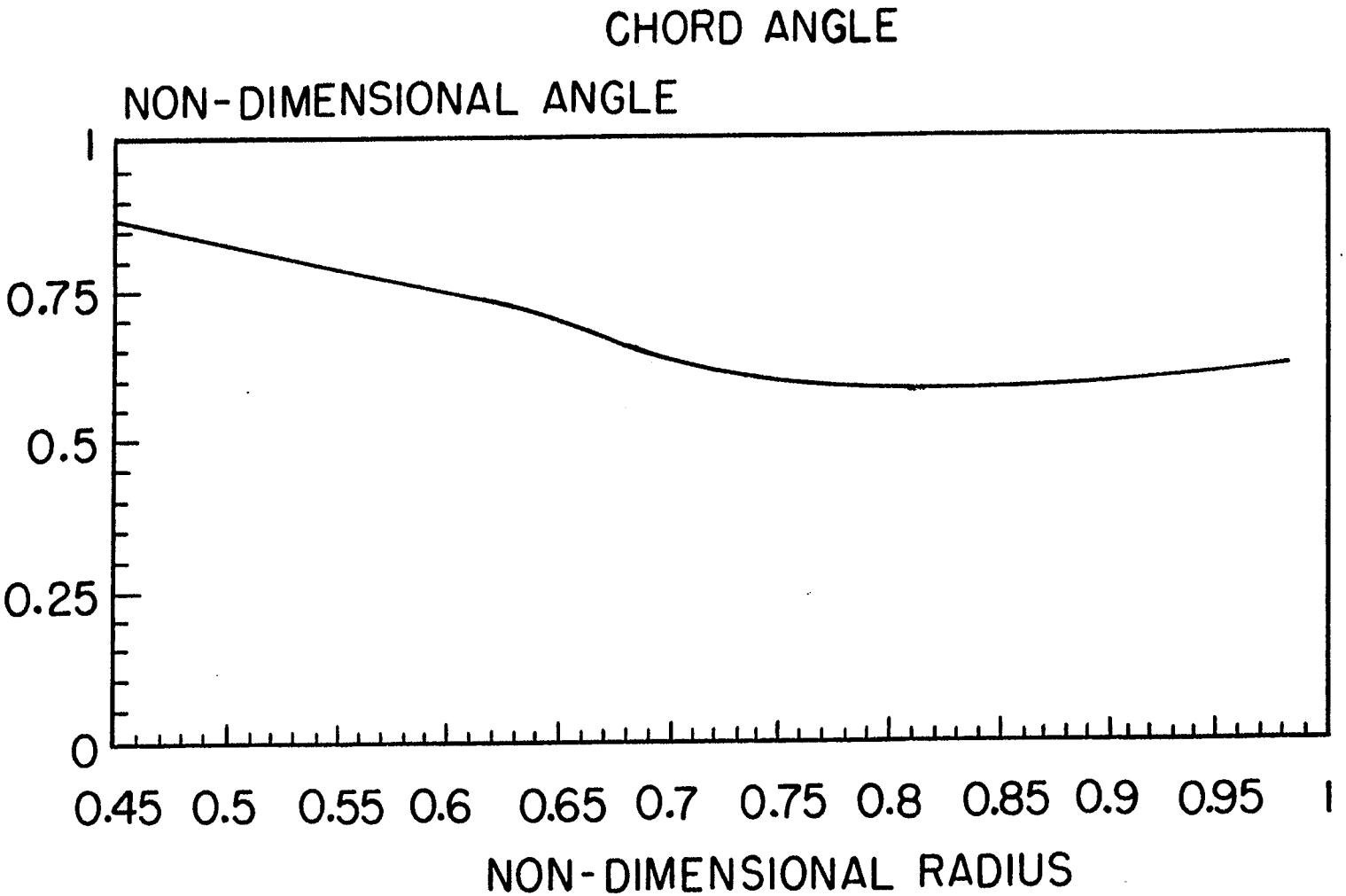
FIG. 14 is a graph showing the variation of chord angle with respect to blade span.

Referring again to FIG. 1, the blades of the fan will now be described. As shown in FIG. 1, each blade is forwardly skewed in that the medial line of the blade (which is the line obtained by joining the points that are circumferentially equidistant from the leading edge B and the trailing edge C of the blade) is curved in a direction (root to tip) corresponding to the direction D of rotation of the fan 2. The leading and trailing edges B,C are similarly curved. This skew is referred to herein as the substantially colinear sweep of the blade and is indicated diagrammatically by the angle $\lambda$ in FIG. 4*a*. Furthermore, each blade is secured to the hub at a dihedral angle which is illustrated diagrammatically by angle $\mu$ in FIG. 4*b*. The dihedral angle $\mu$ is the angle between a tangent to the blade surface and the plane containing the axis of rotation. Furthermore, the blade is pitched so that the leading and trailing edges B and C are not in the same plane. The pitch angle $\alpha$ is shown in FIG. 4*c*. The variation of pitch (or chord) angle with the radius of the blade moving front root to tip as shown in FIG. 14.

Figure 8:
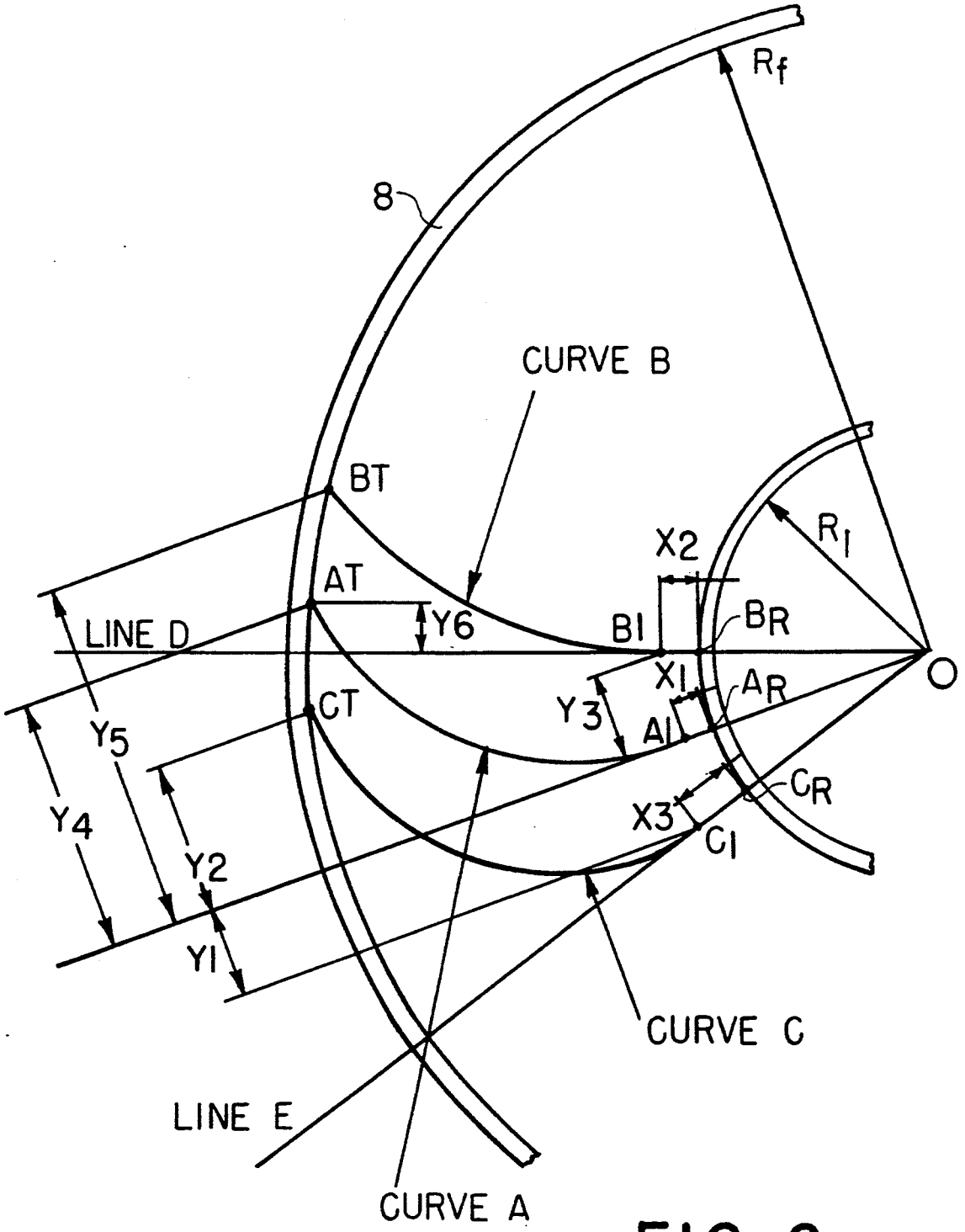
FIGS. 8 and 9 are axial plan elevations of a blade.

Reference will now be made to FIG. 8 to describe the tangential sweep $\lambda$ of the blade. In FIG. 8, the fan origin is indicated as O and three lines are shown emanating radially from the origin, line D, line x and line E. The leading edge of the blade, curve B, has a first part BR-BI of length x2 which extends substantially colinearly with the line D. The medial line, curve A, similarly has a first part AR-AI of length x1 substantially colinearly with the line x and the curve C defining the trailing edge has a similar part CR-CI of length x3 extending substantially colinear with the radial line E. The lengths x1, x2 and x3 are preferably between 5% and 10% of the curve length.

As can be seen in FIG. 8, the curved portions BR-BI and CR-CI do not extend exactly colinearly with their respective radial lines D and E over the whole of the length x2 and x3. However, these portions should be designed to be as close to colinearly with the radius as possible, subject to other design constraints. The variation of the portion BR-BI from the radius can hardly be distinguished in FIG. 8, but the variation of the portion CR-CI is clearer. Thus, it will be understood that the term "colinear" used herein includes within its scope substantially but not necessarily completely colinear portions. As explained earlier, the provision of a linear portion at the root region of the blade increases the strength of the blade at the root portion.

In another embodiment, the points BI,AI and CI are further along their respective curves B and C, and in particular can lie any distance up to 50% of the curve length. In this embodiment, the portions CR-CI and BR-BI are skewed in one direction up to the substantially colinear point CI and the blade then skews in the opposite direction between CI and CT and between BI and BT, CT and BT being the contact points of the blade tip with the outer band 8.

The points AI, BI and CI (defining the lengths x1, x2 and x3) may all be placed on the same circle defined from the fan origin O or may be on different circles. The preferred relationship between the values AI, BI and CI is given below with reference to the points of intersection of these curves AT, BT, CT with the outer band 8. Lines are drawn parallel to the radial line x to intersect respectively the points BT, AT, CT, BI and CI. The following distances are measured from the radial line x to these lines as follows:

Y5 to the line intersecting BT
Y4 to the line intersecting AT
Y2 to the line intersecting CT
Y3 to the line intersecting BI
Y1 to the line intersecting CI Preferably the relationship between these values is as follows:

Y2 is greater than or equal to Y1
Y4 is greater than or equal to Y3
Y5 is greater than or equal to Y4
Y6 (the distance between line D and a line running parallel to it intersecting AT) is greater than or equal to 0
Y4 is greater than Y2

However, other relationships between these values may be satisfied depending on the application of the blade, provided that there is always a portion CI, BI of the blade tangential to a radius.

Figure 9:
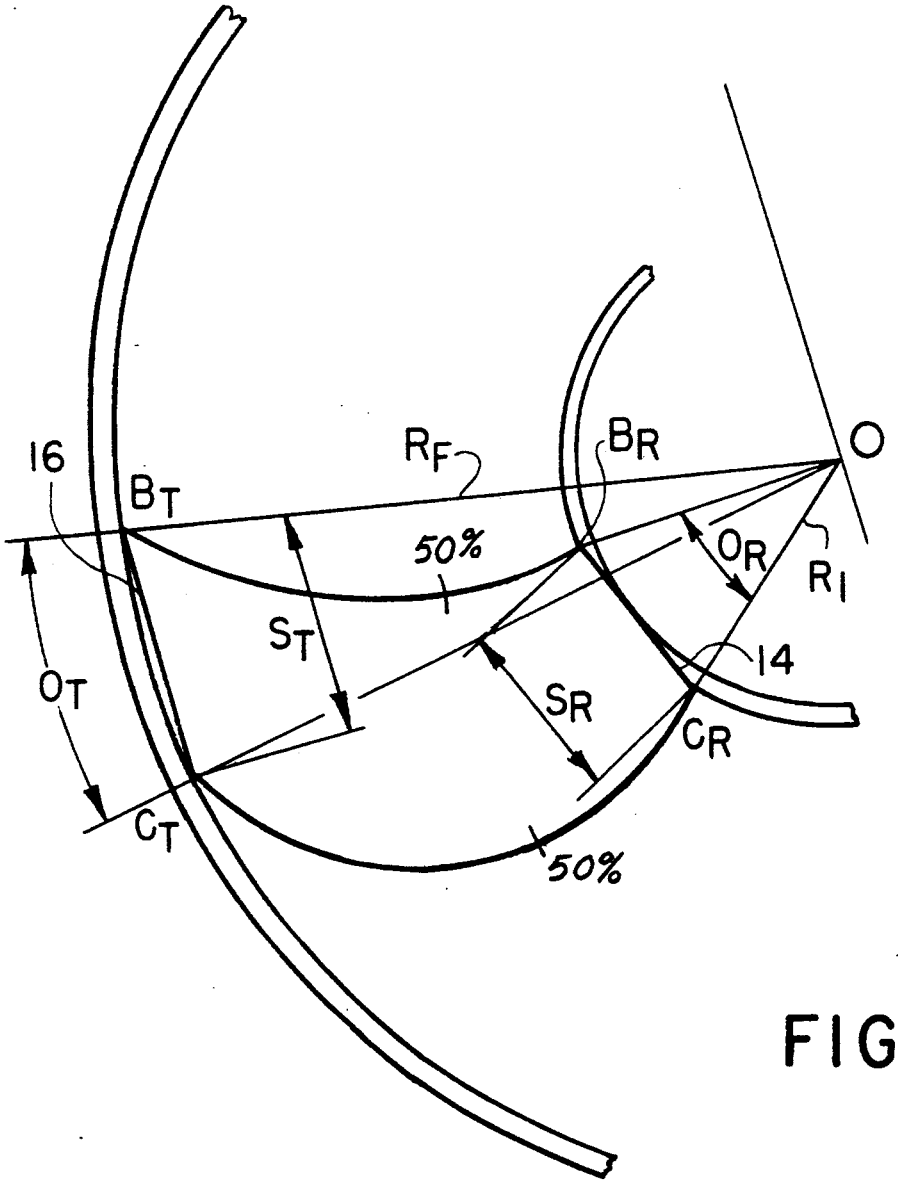

FIG. 9 illustrates the relationship between the chord width projection at the root 14 of the blade and that at the tip 16. Ri is the radius of the hub measured from the fan origin O and $\Theta_R$ is the angle subtended by the points CR and BR (the root points of the trailing and leading edges). The root chord length $S_R$ is Ri $\Theta_R$ where $\Theta_R$ is in radians.

The angle $\Theta_t$ subtended by radii intersecting the points CT,BT defines the tip chord width projection as $S_t = R_f \Theta_t$ where $R_f$ is the outer fan radius. In the illustrated embodiment, $\Theta_R$ is greater than $\Theta_t$ and $S_t$ is greater than or equal to $S_R$.

Figure 12:
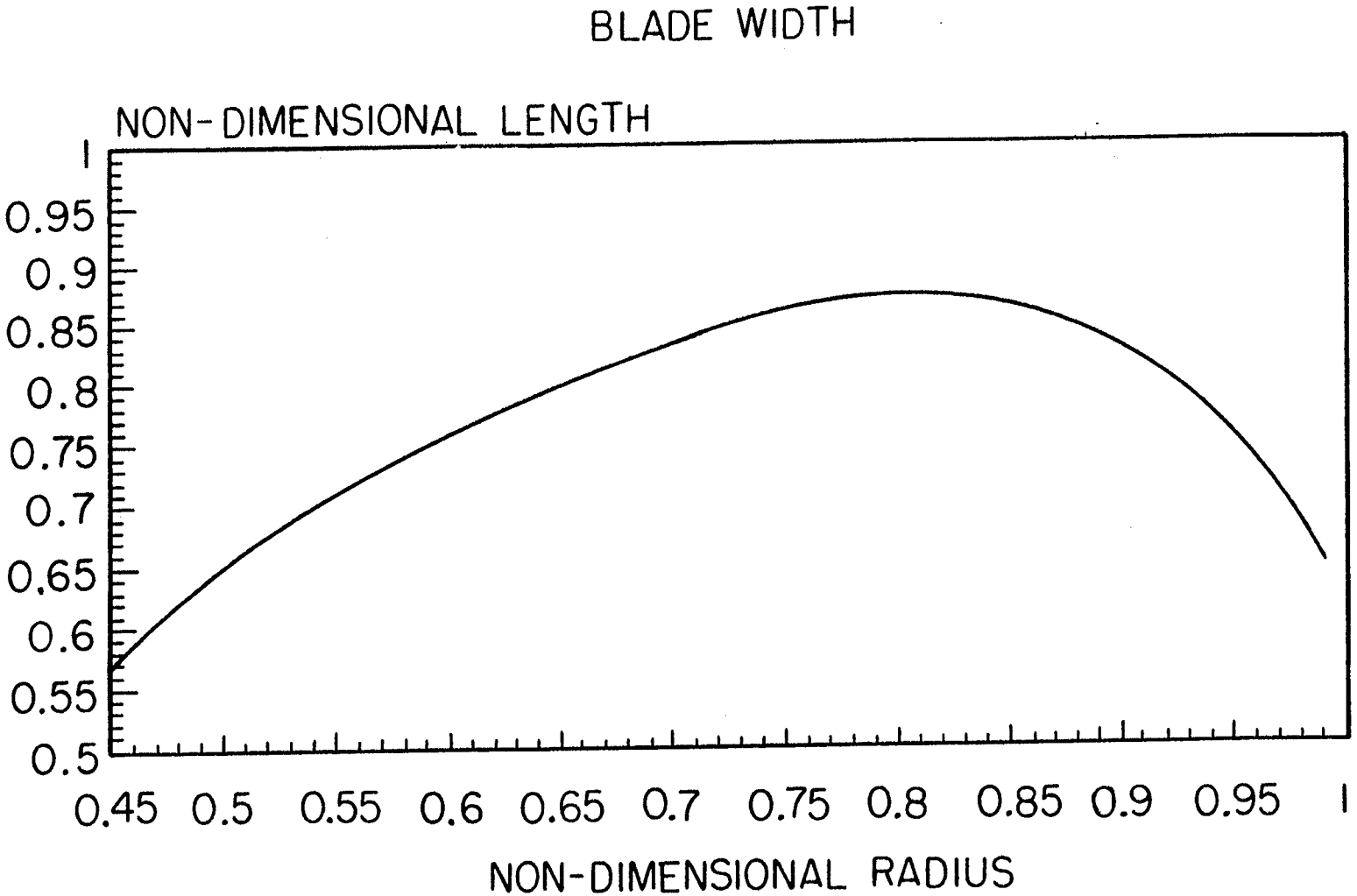
FIG. 12 is a graph showing the variation of projected width of the blade with respect to blade span.

The chord width gradually increases from the root of the blade for a distance corresponding to 50–70% of the span of the blade and then decreases continuously for the remaining 50–30% of the span of the blade. The relationship of the chord width with respect to the radius of the fan (the span of the blades) is given in FIG. 12. The variation of the chord angle with respect to the radius of the fan is given in FIG. 14. The projected blade width follows closely the chord width thus gradually increases from the root of the blade for a length corresponding to 50–70% of the span of the blade and then decreases continuously for the remaining 50–30% of the span of the blade.

FIG. 10 shows in section the blade 6 and its connection at its root to the hub 4 and at its tip to the band 8. FIGS. 46 and 10 clearly show a variation in the dihedral angle $\mu$ such that the dihedral angle decreases with respect to the radius of the fan along the span of the blade over the first 65–75% of the blade span and then stays constant for the remaining 35–25%. As an alternative to the dihedral angle remaining constant over the remaining 35–25% of the blade span, it could increase slightly over this distance.

Figure 11:
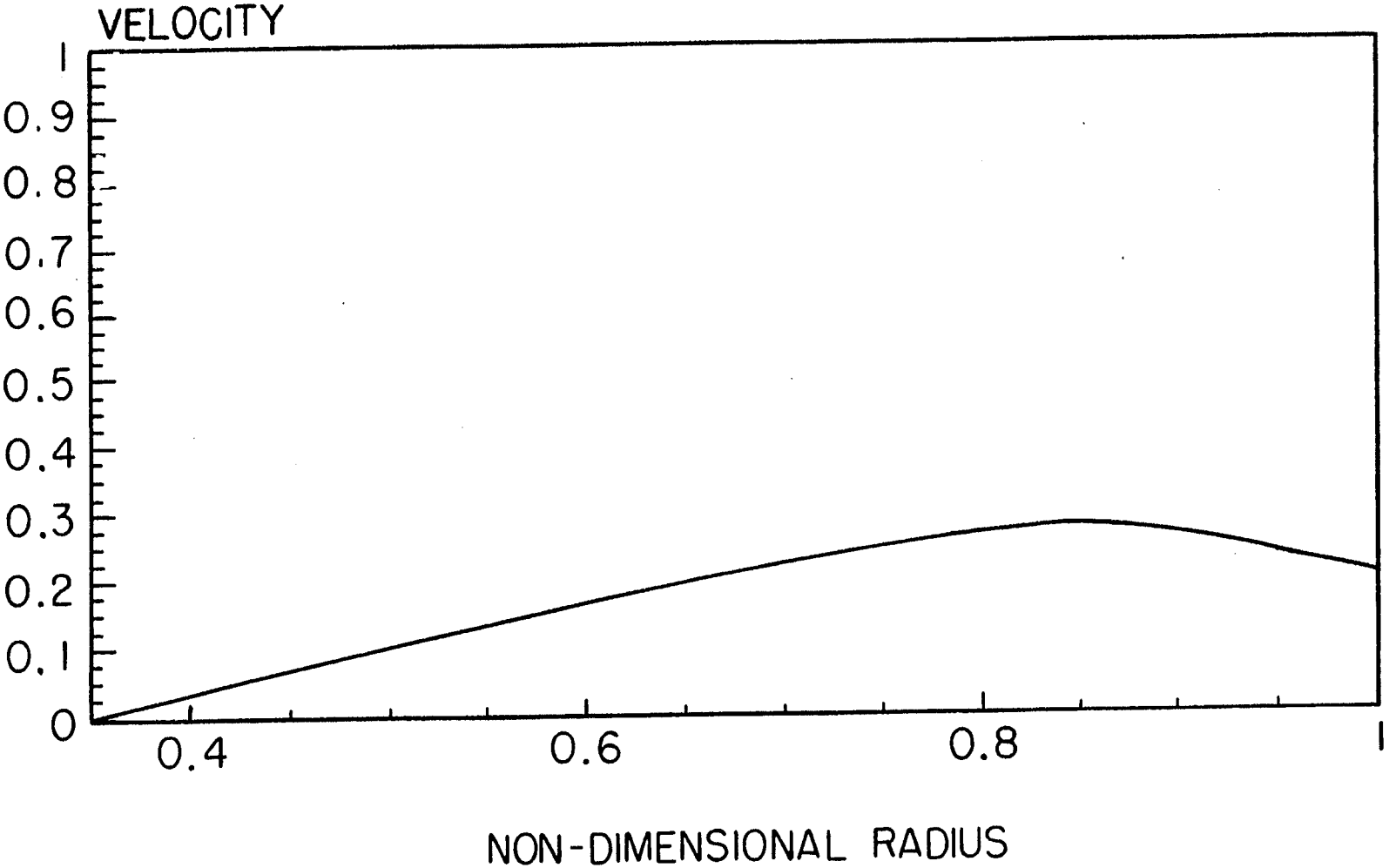
FIG. 11 is a graph showing the variation of velocities along the blade span.

The blade described herein provides a downstream variable axial flow velocity which increases continuously from the hub 4 to the outermost tip 16 of the blade, with the maximum axial velocities occurring over the span of the blade at the outermost 25–35% of the blade. The variation in velocity with respect to radius is shown in FIG. 11. This variation enables the performance efficiency of the fan to be optimised whilst reducing the noise level.

Figure 13:
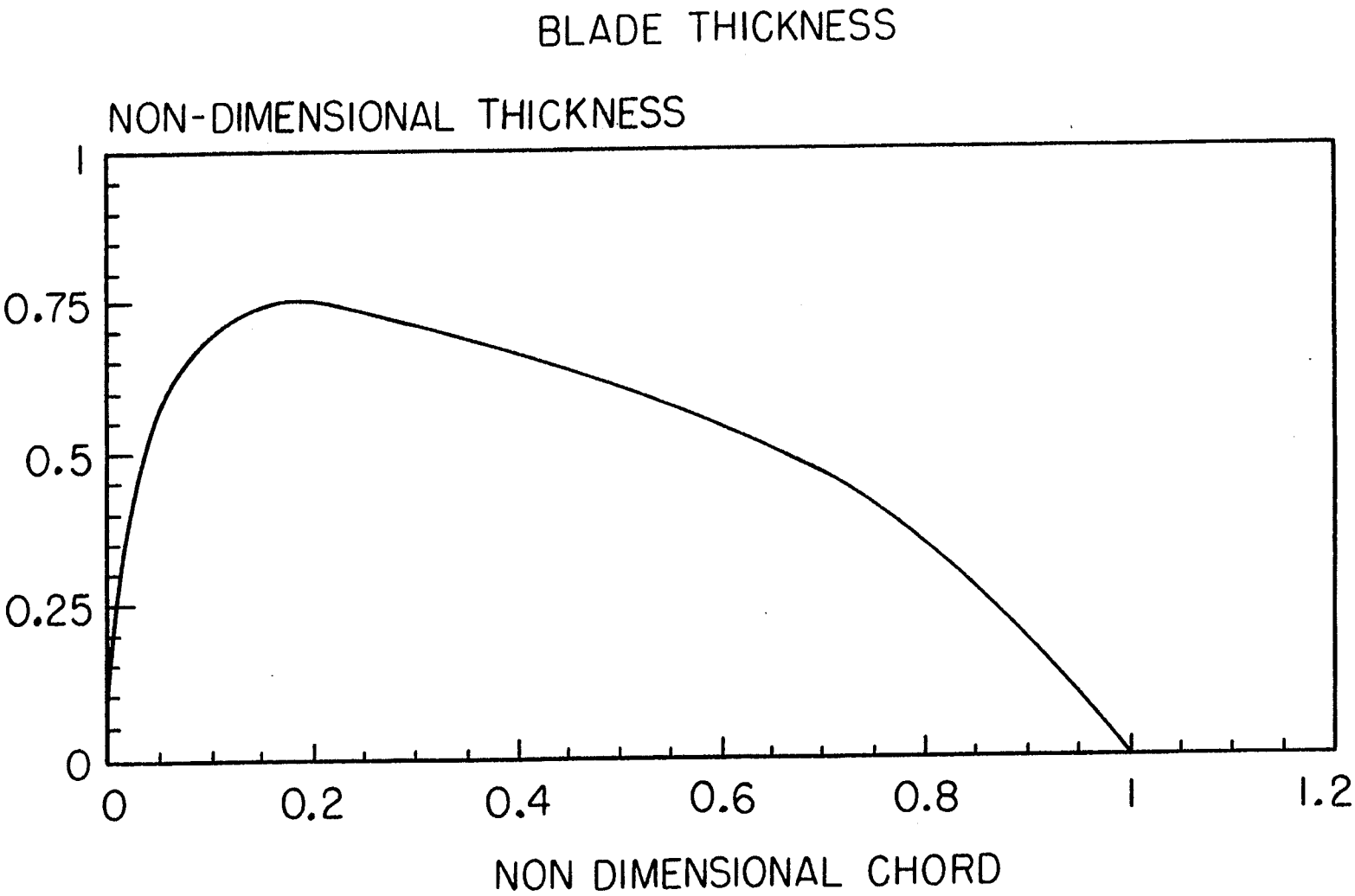
FIG. 13 is a graph showing the variation of blade thickness with respect to blade chord.

The blade thickness decreases spanwise of the blade and also varies across the chord length. FIGS. 10 and 13 show the variation of blade thickness across the dihedral plane and across the chord width of the blade. The blade thickness has been calculated to optimally reduce the weight of the blade, aerodynamic (aerobic) losses and noise.

While the preferred embodiment of the present invention has been described, it will be apparent that other variations, alterations or modifications are possible without departing from the main principles of the invention and such modifications, alterations and variations are intended to fall within the scope of the appended claims.

In particular, the fan described herein can be used without an outer band 8. Furthermore, although a preferred method of manufacture is by injection moulding of a plastic section which provides the hub, blades and band integrally, other manufacturing processes are possible using a combination of plastic and metal as known in the art.

What is claimed is:

1. A fan comprising a hub rotatable about an axis at the centre of the fan and plurality of blades each having a root region secured to the hub and extending radially outwardly to a tip region, wherein each blade has leading and trailing edges which each include a portion substantially colinear with a respective radius extending from the centre of the fan, wherein each blade has a chord width at the root region, the chord being taken across an arc defined by the radius of the hub and the contact points of the leading and trailing edges with the hub, which is not greater than the chord width at the tip region, the chord at the tip being taken across an arc defined by the radius of the fan and the contact points of the leading and trailing edges with said tip arc.

2. A fan according to claim 1, wherein the chord length increases from the root region of the blade over a first portion of the span of the blade and then decreases over a second portion of the span of the blade.

3. A fan according to claim 2, wherein the first portion extends for a distance lying between 50–70% of the blade span.

4. A fan according to claim 2, wherein each blade has a surface which is curved so that the dihedral angle varies along the span of the blade moving from the root to the tip, the dihedral angle being the angle defined between a plane substantially colinear to the surface of the blade and the plane containing the axis of rotation of the fan, the dihedral angle decreasing moving from the root to the tip over a first portion of the span of the blade, said first portion being between 65–75% of the total span.

5. The fan according to claim 4, wherein the dihedral angle stays constant after said first portion.

6. The fan according to claim 4, wherein the dihedral angle increases gradually over a second portion of the blade after said first portion.

7. A fan according to claim 2, wherein the tip regions of the blade are secured to an outer annular band.

8. A fan according to claim 1, wherein each blade has a surface which is curved so that the dihedral angle varies along the span of the blade moving from the root to the tip, the dihedral angle being the angle defined between a plane tangential to the surface of the blade and the plane containing the axis of rotation of the fan, the dihedral angle decreasing moving from the root to the tip over a first portion of the span of the blade, said first portion being between 65–75% of the total span.

9. The fan according to claim 8, wherein the dihedral angle stays constant after said first portion.

10. The fan according to claim 8, wherein the dihedral angle increases gradually over a second portion of the blade after said first portion.

11. A fan according to claim 1, wherein the tip regions of the blade are secured to an outer annular band.

12. A fan according to claim 11 wherein the outer annular band has an axially extending part and an annular radially extending part, each blade being secured to the band with a leading edge thereof extending substantially colinearly with the radially extending part of the outer annular band.

13. A fan comprising a hub rotatable about an axis at the centre of the fan and plurality of blades each having a root region secured to the hub and extending radially outwardly to a tip region wherein each blade has leading and trailing edges which each include a portion substantially colinear with a respective radius extending from the centre of the fan, wherein the leading and trailing edge each have a portion at the root region of the blade which extends substantially colinearly with a respective radius extending from the centre of the fan for the distance along the length of each of the leading and trailing edges which lies between 5% and 10% of the total length, after which the leading and trailing edges curve continuously, and further wherein each blade has a chord width at the root region, the chord being taken across an arc defined by the radius of the hub and the contact points of the leading and trailing edges with the hub, which is not greater than the chord width at the tip region, the chord at the tip being taken across an arc defined by the radius of the fan and the contact points of the leading and trailing edges with said tip arc.

14. A fan according to claim 13, wherein the chord length increases from the root region of the blade over a first portion of the span of the blade and then decreases over a second portion of the span of the blade.

15. A fan according to claim 14, wherein the first portion extends for a distance lying between 50–70% of the blade span.

16. A fan comprising a hub rotatable about an axis at the centre of the fan and plurality of blades each having a root region secured to the hub and extending radially outwardly to a tip region, wherein each blade has leading and trailing edges which each include a portion substantially colinear with a respective radius extending from the centre of the fan, wherein the substantially colinear portion of the leading and trailing edges lies between the root region of the blade and a point lying 50% along the length of the leading and trailing edges, the leading and trailing edges being skewed in one direction between the root region and said tangent point, the direction of skew being changed at the tangent point and further wherein each blade has a chord width at the root region, the chord being taken across an arc defined by the radius of the hub and the contact points of the leading and trailing edges with the hub, which is not greater than the chord width at the tip region, the chord at the tip being taken across an arc defined by the radius of the fan and the contact pints of the leading and trailing edges with said tip arc.

17. A fan according to claim 16, wherein the chord length increases from the root region of the blade over a first portion of the span of the blade and then decreases over a second portion of the span of the blade.

18. A fan according to claim 17, wherein the first portion extends for a distance lying between 50–70% of the blade span.

19. A fan comprising a hub rotatable about an axis at the centre of the fan and plurality of blades each having a root region secured to the hub and extending radially outwardly to a tip region, wherein each blade has leading and trailing edges which each include a portion substantially colinear with a respective radius extending from the centre of the fan, wherein each blade has a surface which is curved so that the dihedral angle varies along the span of the blade moving from the root to the tip, the dihedral angle being the angle defined between a plane substantially colinear to the surface of the blade and the plan containing the axis of rotation of the fan, and further wherein the dihedral angle decreases moving from the root to the tip over a first portion of the span of the blade, said first portion being between 65% and 75% of the total span and then stays constant.

20. The fan according to claim 19, wherein the dihedral angle stays constant after said first portion.

21. The fan according to claim 19, wherein the dihedral angle increases gradually over a second portion of the blade after said first portion.

22. A fan comprising a hub rotatable about an axis at the centre of the fan and a plurality of blades each having a root region secured to the hub and extending radially outwardly to a tip region, wherein each blade has a surface which is curved so that the dihedral angle varies along the span of the blade moving from the root to the tip, the dihedral angle being the angle defined between a plane substantially colinear to the surface of the blade and the plane containing the axis of rotation of the fan, the dihedral angle decreasing moving from the root to the tip over a first portion of the span of the blade, said first portion being between 65–75% of the total span and then staying constant for the remainder of the span of the blade.

23. A fan comprising a hub rotatable about an axis at the centre of the fan and a plurality of blades each having a root region secured to the hub and extending radially outwardly to a tip region, wherein each blade has the following characteristics:

a) the leading and trailing edges each have a portion extending substantially colinearly with a respective radius extending from the centre of the fan, said portion lying between 5% and 10% of the length of each edge;

b) the blade surface is curved so that the dihedral angle varies along the span of the blade moving from the root to the tip; and c) the chord width at the root region is not greater than the chord width at the tip region.

24. A fan comprising a hub rotatable about an axis and a plurality of blades each having a root region secured to the hub and extending radially outwardly to a tip region, the fan further comprising an annular band having an axially extending part and a radially extending annular region to which the tip region of each of said plurality of blades is secured, wherein each blade is secured to the band with a leading edge of the blade extending substantially colinearly with the radially extending annular region.

25. A fan comprising a hub rotatable about an axis at the centre of the fan and plurality of blades each having a root region secured to the hub and extending radially outwardly to a tip region, wherein each blade has leading and trailing edges which each include a portion substantially colinear with a respective radius extending from the centre of the fan, wherein the tip regions of the blade are secured to an outer annular band, and further wherein the outer annular band has an axially extending part and an annular radially extending part, each blade being secured to the band with a leading edge thereof extending substantially colinearly with the radially extending part of the outer annular band.

26. A fan comprising a hub rotatable about an axis at the centre of the fan and plurality of blades each having a root region secured to the hub and extending radially outwardly to a tip region, wherein each blade has leading and trailing edges which each include a portion substantially colinear with a respective radius extending from the centre of the fan, wherein the tip regions of the blade are secured to an outer annular band, and further wherein the outer annular band has an axially extending part extending from a rear of the fan to a front of the fan and wherein a plane passing through the rear of the hub perpendicular to the axis of rotation is spaced from a plane passing through the rear of the outer annular band by a distance which varies in the range 0–50% of the axial length of the band.

* * * * *